United States Patent [19]

Harmsen

[11] Patent Number: 4,609,144

[45] **Date of Patent: * Sep. 2, 1986**

[54] RAILROAD TIE COVER

[75] Inventor: John L. Harmsen, Vienna, Va.

[73] Assignee: STEDEF S.A., Saint Cloud, France

[ * ] Notice: The portion of the term of this patent subsequent to Nov. 2, 1999 has been disclaimed.

[21] Appl. No.: 604,469

[22] Filed: Apr. 27, 1984

[51] Int. Cl.[4] ..... E01B 26/00

[52] U.S. Cl. ..... 238/1; 238/83

[58] Field of Search ..... 238/1, 2, 29, 62, 82–84, 238/98, 104, 107, 115, 116, 118, 283, 382

[56] References Cited

U.S. PATENT DOCUMENTS

| | | | |
|---|---|---|---|
| 1,218,141 | 3/1917 | Wells | 238/107 X |
| 2,377,942 | 6/1945 | Johnson | 238/283 |
| 3,289,941 | 12/1966 | Sonneville | 238/116 |
| 3,295,760 | 1/1967 | Moses | 238/283 |
| 3,550,850 | 12/1970 | Sonneville | 238/283 X |
| 3,790,078 | 2/1970 | Egerbork et al. | 238/2 |
| 3,831,842 | 8/1974 | Tamura | 238/283 X |
| 3,907,200 | 9/1975 | Bernard | 238/283 X |
| 4,254,908 | 3/1981 | Matsubara | 238/283 |
| 4,303,199 | 12/1981 | Eisses | 238/2 |
| 4,356,968 | 11/1982 | Harmsen | 238/1 |
| 4,489,884 | 12/1984 | Harmsen | 238/1 |

FOREIGN PATENT DOCUMENTS

| | | | |
|---|---|---|---|
| 11504 | 1/1977 | Japan | 238/2 |
| 18610 | 2/1977 | Japan | 238/2 |

*Primary Examiner*—Randolph Reese

*Attorney, Agent, or Firm*—Breneman, Georges Hellwege & Yee

[57] ABSTRACT

A universal railroad tie cover of a substantially rectangular configuration is provided which is composed of an elastomer material having one or more openings for receiving one or more elastomer pads for increasing the resiliency of rail fastening systems in railroad track beds with and without ballast to prolong the service life of timber and concrete railroad ties. The universal railroad tie cover has a center section with at least one opening and two side portions for receiving interchangeable specially designed pads some of which may be designed for a particular system and/or for wood or concrete ties to prolong operational life by increasing the resiliency of the rail fastening system. The universal railroad tie cover and particular pads are designed to be manufactured and shipped in a flat configuration which can be cut and installed as a three dimensional cover at the work site to accommodate varying lengths of timber and concrete ties as may be required in special track work.

19 Claims, 12 Drawing Figures

RAILROAD TIE COVER

CROSS REFERENCE TO RELATED APPLICATIONS

This invention pertains to new and useful improvements in railroad tie covers and is a continuation-in-part application of U.S. application Ser. No. 429,271 filed Sept. 30, 1982 which issued as U.S. Pat. No. 4,489,884 on Dec. 25, 1984 which application is a continuation-in-part application of U.S. application Ser. No. 195,921 filed Oct. 10, 1980 which issued as U.S. Pat. No. 4,356,968 on Nov. 2, 1982.

BACKGROUND OF THE INVENTION

1. Field of the Invention

The present invention pertains to an improved resilient railroad tie cover having separate resilient pads for use with either timber or concrete railroad ties to increase the resiliency of the rail track system and increase the service life of the railroad ties. More particularly, the invention provides a railroad tie cover for covering either timber or concrete ties in which the specific requirements of the particular system are accommodated by fixing one or more separate elastomer pads in a restraining means provided in the railroad tie cover. The universal railroad tie cover and the separate pads for specific ties and/or vibrational damping requirements allows both the railroad tie cover and the pads to be manufactured and shipped in a flat configuration and thereafter be cut to length and installed to form a three dimensional tie cover at the work site.

The advantages of the invention allow the universal railroad tie cover to be shipped to the work site and fitted with an elastomer pad specifically designed for concrete ties or for timber ties along with the vibration attenuation requirements for the system in which both the universal railroad tie cover and specially designed pads can be cut to accommodate varying lengths for timber or concrete rail ties that is particularly useful in special track sites such as is employed at rail switches. The utilization of one or more restraining grooves for receiving a separate specially designed pad for the universal railroad tie cover or sleeve not only assists in dampening vibration and distributing loads during train passage but also provides improved rail operation by a reduction in noise and an increase in resiliency in rail tracks with or without ballast.

2. Description of the Prior Art

The prior art employs a variety of resilient pads used under the rail and railroad tie covers for covering ties to increase the resilience of railroad track with and without ballast. Conventional railroad track systems in the United States predominantly employ a ballasted bed of crushed stone for supporting wooden railroad ties which impart some resiliency to the railroad system but which result in harder and noisier railroad tracks. In some applications such as in tunnels or in environments where deep beds of ballast are not practical, resilient pads have been interposed between the railroad track and the railroad tie to increase the resiliency of the railroad system. One such application of a rubber pad to increase the resiliency of a rail positioned on a portion of a wooden tie is illustrated in U.S. Pat. No. 2,779,543.

In many track applications in European countries, wooden ties are not utilized and railroad track systems are in widespread use that do not use ballast. To obtain resiliency, elastomer pads or block tie boots which fit over and around the concrete railroad ties are employed. Illustrative of railroad track systems utilizing railroad track without ballast and block tie boots is U.S. Pat. No. 3,289,941. In such systems, resiliency is imparted by employing a rubber boot or sheath interposed between a concrete tie block and the continuous floor formed of cement, concrete or black concrete. Unlike the present invention, such a prior art system does not provide a universal tie cover that can be interchangeably used for a variety of monolithic and two block tie configurations and is not designed to provide drainage and aeration of the ties. Due to the shape of many prior art railroad tie covers, such prior art covers cannot be used with conventional timber ties.

The known prior art systems in use in the United States for railroad timber ties employ rubber pads and similar flat resilient supports to increase the resiliency of the railroad systems. Such systems generally have not been designed for the purpose of increasing the operational life of railroad timber ties by promoting the drainage of water from the wooden rail tie and drawing air into and around the railroad tie during the loading or unloading of the railroad tie systems such as occurs during the passage of trains.

In addition such known prior art systems have not provided the range of applicability of the present railroad tie cover which can be used for both timber and concrete ties. Unlike the prior art the universal railroad tie cover is designed to accept a specially designed pad for timber and concrete tie applications. The railroad tie cover of the present invention is constructed of an elastomer material designed to not only increase the resiliency of traditional railroad beds with or without ballast as utilized in American railroad installations but also to receive and fix one or more specifically designed pads to provide for aeration and vibration attenuation. The novel cover and pad combination is also constructed to receive a separate pad designed to cooperate with the railroad tie cover to increase the life of the railroad tie by allowing moisture to be drained away from both railroad timber and concrete ties while providing necessary aeration to increase the service life of railroad ties. Aeration and removal of moisture also provides advantages to concrete ties particularly where low temperature could result in freezing of water and subsequent cracking of the tie.

In the application of rubber pads to U.S. prior art systems, the flat rubber pad has traditionally been interposed between the wooden tie and the steel tie plate upon which the steel rail is placed in order to impart limited resiliency to the overall system. Unlike the prior art, the present system is directed to the utilization of a resilient covering for receiving one or more specifically designed pads which are inserted into the bottom portion of the tie cover. The present invention employs a railroad tie cover for railroad systems with and without ballast in which the overall resiliency of the system is achieved by employing a universal tie cover which accommodates specially designed pads for concrete and timber ties. The universal pad may have a flat and smooth outside surface of a desired thickness and hardness whereas the inside surface of the pad includes means for receiving and fixing one or more interchangeable and specially designed to provide for vibration attenuation and aeration requirements of the system. The receiving and fixing means on the inside surface of the universal railroad tie cover may be designed to further promote aeration and channeling of water away from the wooden railroad tie.

The invention further provides a railroad tie cover that is particularly advantageous for in the field application to railroad ties as the tie cover and pads are manufactured, shipped and stored in a flat configuration and with a minimum cost as a result of their novel configuration and design. The railroad tie cover is susceptible to extrusion or molding processes to form a flat and substantially rectangular cover having in its bottom portion one or more pad restraining means for fixing the position of one or more separate pads which may thereafter be installed by inserting the desired pads and attaching the universal railroad tie cover to the railroad ties by bending and fastening the sides around the railroad tie. In addition the tie covers and pads can be installed on standard tie lengths or cut to various sizes at the work site to accommodate tie lengths of varying sizes which are predominantly employed at rail switches and other special track work.

The utilization of the novel railroad tie covers of the present invention further allows the dissipation of shock and vibration that impairs the integrity and useful life of the railroad tie fastening system, protect buildings in adjacent areas from structural damage, and alleviates the nuisance of vibrations to occupants of neighboring buildings while at the same time prolonging the useful life of both concrete and timber railroad ties. The utilization of a separate elastomer pad or a plurality of pads in the tie cover center support reduces track hardness and improves the performance of rail systems by a reduction of noise and maintenance on railroad tie systems utilizing wooden and concrete ties.

SUMMARY OF THE INVENTION

The disadvantages and limitations of prior art systems for increasing the resiliency of rail systems are obviated while providing additional advantages in preserving and prolonging the operational life of wooden and concrete rail tie systems. The present invention not only augments the resilience of the entire rail system, but also provides a protective cover or sleeve that shields the railroad tie from a rail bed that may or may not employ ballast. Where ballast is utilized, the advantages of the invention are further augmented by distributing the load more evenly along the entire bearing surface of the tie while preventing undue wear between the points of contact between the railroad tie and the railroad bed supporting the railroad ties. In ballast applications where the rail bed is made of aggregate the invention allows the ties to be positioned on the railroad bed while achieving the necessary resiliency by utilizing the construction and design of the protective rail cover. In addition to the advantages of providing a more resilient rail system and the incumbent advantages in the reduction of noise, dissipation of stresses and vibrational forces, the present invention allows specially designed pads to be constructed to meet specific engineering requirements to be included in the cover to remove moisture from the railroad tie and promote aeration of the bottom surface and sides of the tie particularly during the loading and unloading of the rails such as occurs with the passage of trains over the rails.

The present universal railroad tie protective cover or sleeve is formed from rubber or other elastomer material to form a substantially flat rectangular cover or sleeve having in its bottom part means for fixing one or more pads designed for either concrete or timber ties. The elastomer sleeve can be formed either by a molding process or by the utilization of extrusion processes such as are well known in the art. The formation of a single flat rubber sleeve for both concrete and timber ties simplifies the production and manufacture of the rubber sleeve and at the same time provides additional advantages in storage, transportation, and utilization of protective covers for railroad ties. In the preferred embodiment of the invention, protective covers and separate concrete and timber tie pads formed in accordance with the invention can be trimmed, cut and installed on timber and concrete railroad ties at the work site in a number of configurations depending upon the nature of the track and the particular application utilized.

On the inside surface of the protective railroad tie cover one or more pad fixing means are provided to accommodate and receive specially designed timber tie or concrete tie pads to form the inside supporting surface of the railroad tie cover. The separate pads for the concrete ties may be constructed of rubber or a suitable elastomer material having a smooth outside surface. The separate support pads for the timber ties preferably include grooves on the surface of the pad to remove moisture and increase resiliency and the operational life of railroad timber ties. The specifically designed pads are designed to be *compatible* with the fixing means provided on the inside surface of the universal railroad cover.

The manufacture of the universal railroad tie cover of the invention is simplified by allowing a single flat cover to be manufactured of a uniform cross-sectional thickness preferably with grooves in the side walls. The separate pads for concrete and timber ties are produced to provide for the specific requirements of the particular installation and are designed to augment the basic properties of the universal railroad tie cover. More particularly in the application of the present invention to timber ties, one or more pads having grooves are placed in the bottom of the railroad tie cover. The shore A hardness of the railroad tie cover and the separate pad for timber ties should be in the range of 60. The composite rate of elasticity or resilience of the combination as will be recognized by those skilled in the art may be modified by changing the number and depth of the grooves in the pad along with the thickness and composition of the rubber pad or suitable elastomer material. In the preferred embodiment of the invention for timber ties one or more grooved pads having a shore A hardness in the range of 60 is utilized having approximately 1 to 3 grooves per inch at a depth of the grooves of about $\frac{1}{4}$ to $\frac{3}{8}$ of an inch. It will, of course, be recognized that modification of the grooved channels, their configuration and depth may be made to provide greater or lesser degrees of resilience and aeration for the bottom of a railroad timber tie. The inside surface of the universal railroad tie cover and both sides of the pad of the railroad tie cover may employ one or more grooves as a means for not only positioning the pad in the universal railroad tie cover but also for channeling water and moisture away from the railroad tie.

In the application of the railroad tie cover to concrete ties smooth or grooved pad is disposed in the universal railroad tie. The smooth pad may be a closed cell elastomer pad to provide the desired rate of elasticity as will be discussed hereinafter in greater detail. The closed cellular pad can be $\frac{1}{2}$ inch in thickness and may for example be a cellular pad that is commercially available through Stedef Incorporated of Falls Church, Va.

The grooves in the side or end portions of the universal railroad tie cover are generally in the neighborhood of about $\frac{1}{4}$ to $\frac{3}{8}$ of an inch in cross-sectional thickness and traditionally utilize from about 2 to 4 grooves per inch in which the grooves may be spaced at about $\frac{1}{4}$ to $\frac{1}{2}$ of an inch apart. Substantially perpendicular to the grooves on the sides may be a number of vertical water channels that may be disposed along the length of the sides at a distance of about 15 centimeters from each other to transport moisture or water from the sides of the railroad tie cover to the bottom portion of the tie cover to thereafter be removed from the railroad tie cover.

The application of the railroad tie covers to railroad ties in either ballastless track or systems utilizing ballast employs a center portion to support the bottom of the railroad tie while the side portions are bent to conform to the sides of the railroad tie and are fastened by the utilization of nails, straps, adhesives or other such known fastening devices. In order to facilitate the contour shaping of the railroad tie cover to the railroad tie, the rubber wall at the division between the center portion of the railroad tie cover and the end or side portions may be of a reduced thickness. Optionally, the reduced thickness resulting from the molding process will, when installed on a tie, form a side water channel to assist in the removal of moisture from the railroad ties. The universal railroad tie cover is of particular advantage in ballast and ballastless track applications as a single cover can be manufactured and employed for both.

In the case of a ballastless system the increased resiliency of the system can be accommodated by the utilization of a thicker or softer insert pad rather than a separate railroad tie cover. Similarly the invention may be adapted to a variety of railroad applications by merely changing the properties of the pad rather than a complete redesigning of the railroad tie cover. The present invention provides further advantages in shipment and installation of the railroad tie covers and pads since they are amenable to shipment in a flat condition and thereafter contoured and installed at the work site. The installation of the railroad tie covers and pads contemplate the cutting of the railroad tie cover and pad to accommodate a wide range of special timber tie lengths as are generally utilized in special track work. Generally, the tie cover and pads can be made of about 30 to 60 inches in length which are sufficient lengths to accommodate standard timber ties. However, in special track work such as at rail switches, other lengths can be easily accommodated by cutting the railroad timber tie cover to the desired lengths at the work site. In some applications, a special flap or cover can be made for the end of the tie cover.

The present invention provides a number of advantages which result in improved resiliency and the protection of timber and concrete ties. The invention further combines the benefits of increased resiliency with the removal of water and aeration for timber or concrete ties by the utilization of grooves and channels which allow the circulation and breathing of air that results when trains pass over the rail as a result of the weight of the train on the bottom of the tie cover and pad which causes a deflection and rebounding of the bottom and sides of the tie covers.

The features of the invention reduce required track maintenance, noise and vibration and increase the operational life of the ties thereby providing a safer and quieter train ride which results in reduced strain and vibrational forces upon both timber and concrete ties. In addition, as a consequence of the design and construction of the novel railroad tie cover and individually designed pads, the invention can be conveniently and inexpensively implemented by extrusion or molding processes which allows the sleeves to be shipped to the work site in a flat configuration and thereafter be installed to suit the particular track requirements at the job site.

DESCRIPTION OF THE DRAWINGS

Other advantages of the invention will become apparent to those skilled in the art from the following detailed description of the invention in conjunction with the accompanying drawings in which.

DETAILED DESCRIPTION OF THE INVENTION

Figure 1:
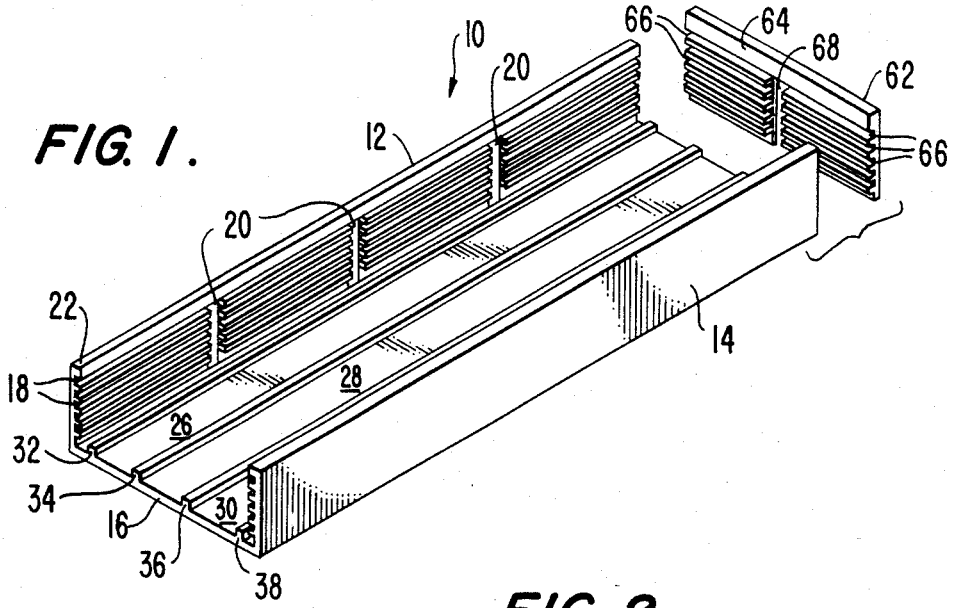
FIG. 1 is a side elevational view of one embodiment of the novel railroad tie cover designed to accommodate one or more separate resilient pads in accordance with the invention.
Figure 2:
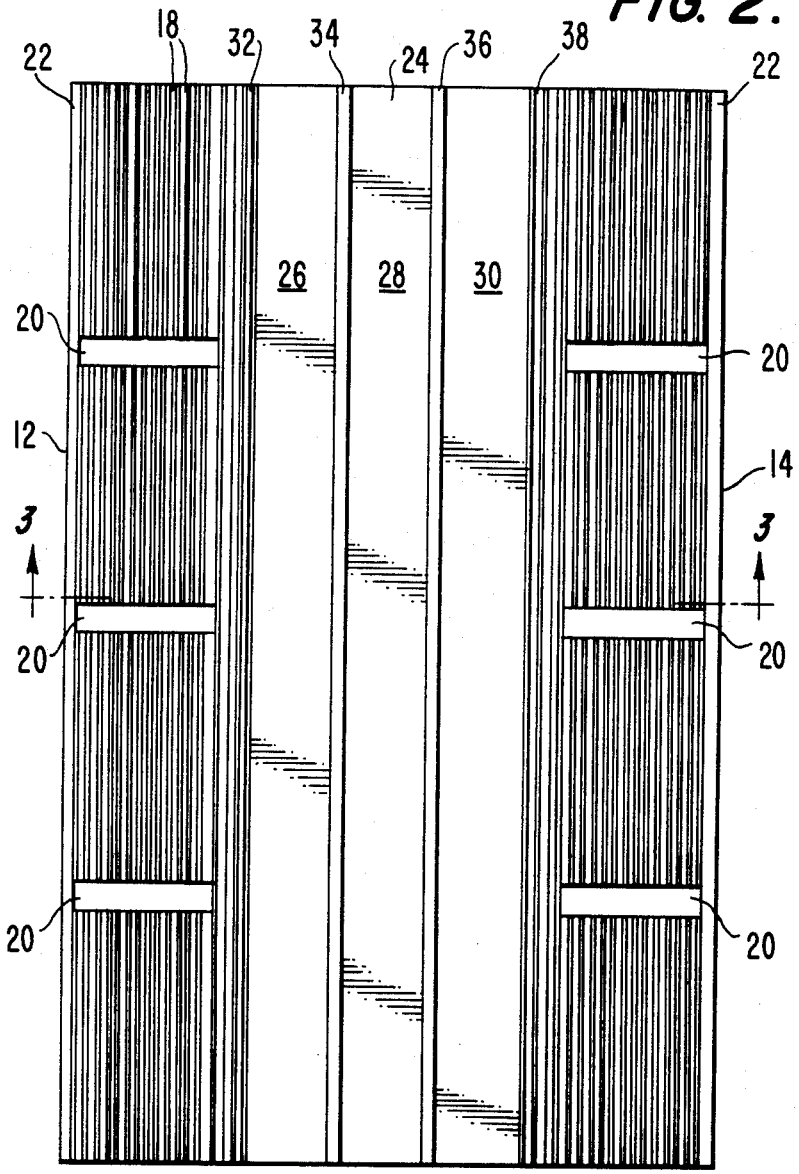
FIG. 2 is a plan view of the railroad tie cover of FIG. 1 in a flat configuration.
Figure 3:
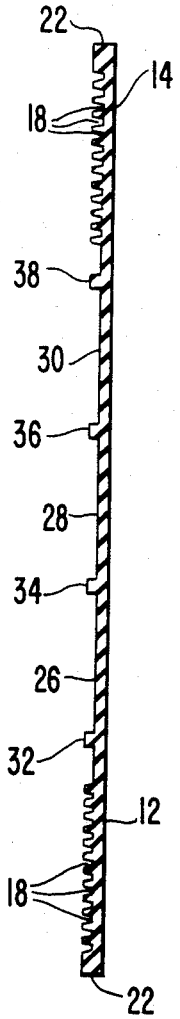
FIG. 3 is a sectional view of the railroad tie cover taken along line 3—3 of FIG. 2.

Referring now to FIGS. 1, 2 and 3 a universal railroad timber tie cover 10 formed from rubber or other elastomer material is illustrated having two sides 12 and 14 and a bottom 16 for receiving one or more pads specifically designed for the specific tie and system which when assembled and attached to the bottom and sides of the railroad tie forms a protective cover for providing resiliency and prolonging the life of the tie.

Sides 12 and 14 may optionally include a plurality of horizontal grooves 18 for providing resiliency to the side walls and the circulation of air around the sides of the tie that is particularly advantageous in applications employing timber ties. In the preferred embodiment of the invention grooves 18 are provided to not only aerate the tie but also to dampen vibration and impart resiliency to the sides of the tie to prevent undesirable rubbing, wear and abrasion between the sides of the tie cover and the tie.

Optional grooves 18 may be utilized which may be bi-sected at various points along sides 12 and 14 by a plurality of cross grooves 20 to assist in the channeling of water and moisture from the sides of the timber tie to the bottom supporting surfaces of the tie. Cross grooves 20 are formed in sides 12 and 14 at a point below the lips 22 on side 12 and 14 to minimize the amount of water and moisture that is admitted between the tie and the sides 12 and 14 of the universal railroad tie cover. Typically cross grooves 20 interconnect all of the grooves 18 to provide drainage of moisture from the sides of the tie and grooves 18 to the bottom portion of the timber tie.

The bottom 16 of the universal railroad tie cover 10 on the inside major face 24 includes structure for receiving and fixing the position of specially designed pads of a compatible structure which as illustrated by way of example in cover 10 includes three major openings 26, 28 and 30 defined by four ribs 32, 34, 36 and 38. The three openings 26, 28 and 30 serve a dual function of aeration and channeling moisture and water away from a timber tie 46 but more importantly define a recess for receiving and fixing one or more specially designed mechanically compatible resilient elastomer strips or pads 40, 42 and 44 (FIG. 6) to provide the desired resiliency for all ties. The specially designed pads may include grooves 48 for increasing resiliency and for channeling moisture away from both timber and concrete ties. In the preferred embodiment of the invention the universal railroad tie cover 10 accommodates specially designed pads with grooves for timber ties and smooth pads for concrete ties which also provides a means for providing positive selection of the proper pad at the work site for assembly into the universal railroad tie cover.

The composite resiliency of the combination of the bottom 16 of the universal railroad tie cover 10 and the resilient pad or pads 40, 42 and 44 preferably provides a static stiffness of between 5 and 40 lbs. per square inch per millimeter deflection of the composite material. The preferred range for both the grooved railroad tie cover and the composite railroad tie cover with one or more fixing and restraining means such as openings 26, 28 and 30 into which one or more resilient pads are placed provides a static stiffness in the range of about 10–20 lbs. per square inch per millimeter deflection. The necessary composite resiliency can be achieved by employing a ½ inch closed cellular elastomer pad or similar material as is available through Stedef Incorporated of Falls Church, Va., along with a railroad tie cover having a uniform thickness of about ⅛ to ¼ of an inch thick.

Figure 6:
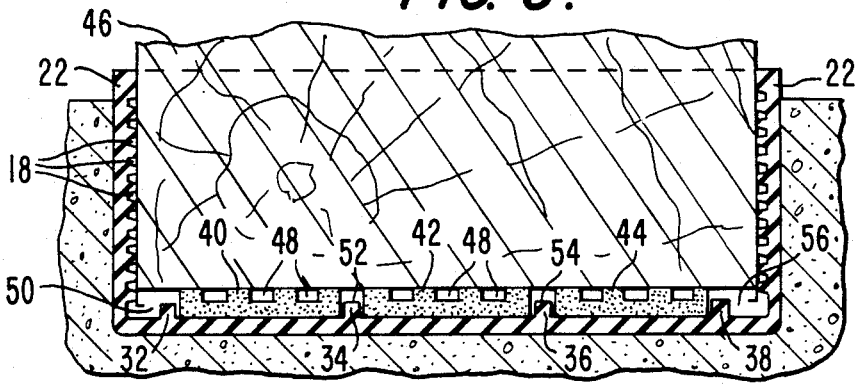
FIG. 6 is a sectional view of the railroad tie cover of FIG. 1 illustrating the application of the cover and resilient pads to a railroad timber tie disposed in a concrete substrate.

In the application of the invention to concrete ties the shock and vibration attenuation between the railroad tie 46 and the concrete substrate is provided for by resilient pads 40, 42 and 44 in combination with the center bottom 16. Lateral forces are dissipated by the channels or grooves 18 in sides 12 and 14 of railroad tie cover 10. The channeling of moisture and aeration advantages of the invention is provided in the application of the invention to timber and concrete ties by providing grooves 48 in pads 40, 42 and 44 as illustrated in FIG. 6 so that the combination of pads 40, 42 and 44 with grooves 48 along with ribs 32, 34, 36 and 38 and the spaces 50, 52, 54 and 56 provide aeration and channel moisture and water away from timber tie 46.

Figure 4:
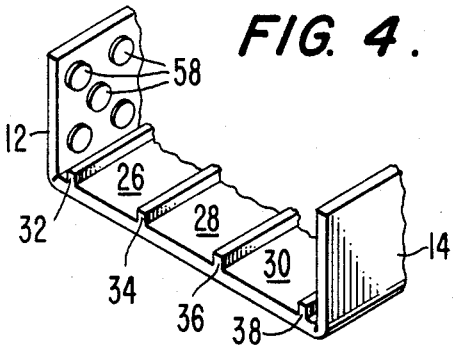
FIG. 4 is a fragmentary side elevational view of an alternative embodiment for providing a fixing and restraining means formed from grooves in the railroad tie cover of FIG. 1.
Figure 5:
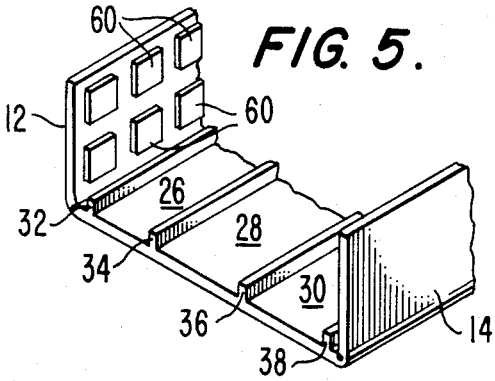
FIG. 5 is a fragmentary side elevational view of a further alternative embodiment for providing a fixing and restraining means formed by utilizing grooves in the railroad tie cover of FIG. 1.

Alternative embodiments to grooves 18 and 48 for imparting resiliency to sides 12 and 14 of the novel universal railroad tie cover or to specifically designed pads 40, 42 and 44 are illustrated in FIGS. 4 and 5. In FIG. 4 a section of the railroad tie cover 10 is illustrated in which the grooves in the sides 12 and 14 have been replaced by the utilization of spheroid projections 58. In FIG. 5 the substantially longitudinal grooves 18 in the sides 12 and 14 of the railroad tie cover 10 have been replaced by the utilization of rectangular or bifurcated pyramoidal projections 60. It will be recognized that resiliency in the pad and universal railroad tie cover may be provided by the utilization of grooves or channels without the necessity of their being longitudinal or along the entire length of the rail tie cover and that the definition of grooves and the pad fixing and restraining means as contemplated by the present invention contemplates such modifications as illustrated in FIGS. 4 and 5. It will also be recognized by those skilled in the art that openings 26, 28 and 30 can be defined by spheroid projections 58 or bifurcated pyramoidal projections 60 with a compatible means on the pads for mating with the projections for fixing the pads in the railroad tie cover. It will be further recognized that the advantages of the invention can be accomplished by utilizing a variety of configurations of channels and grooves that are designed to increase the overall resiliency of the railroad track thereby reducing track maintenance and noise while increasing the life of the railroad ties.

An optional end cover or flap 62 (FIG. 1) may be provided for attachment to the end of the universal railroad timber tie to cover. The end cover 62 may optionally include grooves to provide resiliency and in the case of timber ties to aerate the end of the railroad timber tie. The utilization of cover 62 assists in prolonging the operational life of a timber tie by providing for the circulation of air and the channeling of moisture away from the timber tie in a manner similar to that provided by sides 12 and 14 to assist in resiliently absorbing lateral track forces. More particularly, the advantages of the end flap may be achieved by the utilization of a lip 64 for preventing moisture from entering in the railroad tie and also a series of grooves 66 similar to grooves 18 on sides 12 and 14. Similarly, a cross groove 68 may be provided for connecting grooves 66 together and to provide a drain for the bottom of the tie and preferably into one of the openings 28 at the bottom of the timber tie cover.

Figure 7:
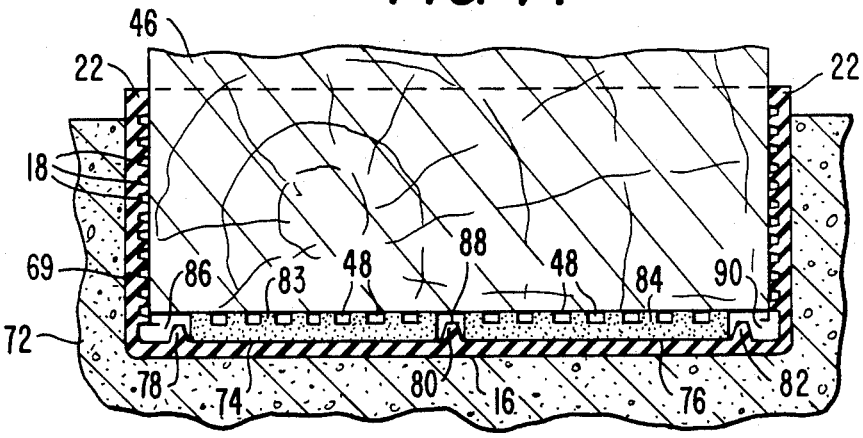
FIG. 7 is a sectional view of a further embodiment of a railroad tie cover and resilient pad combination illustrating the application of the cover to a railroad timber tie disposed in a concrete substrate.

The advantages of the invention may be achieved by employing the combination railroad tie cover and the resilient pads in a variety of modes. The railroad tie cover and pad combination may employ longitudinal bend lines at or near spaces 50 and 56 to assist in channelling water and moisture away from the railroad tie cover and in bending sides 12 and 14 around the railroad tie. In FIG. 7 a universal railroad tie cover 70 is illustrated disposed in an operative configuration around a timber tie 46 in a concrete railroad bed 72 wherein center bottom 16 is divided into two openings 74 and 76 by ribs 78, 80 and 82. A pair of resilient pads 83 and 84 are placed in channels 74 and 76 to resiliently support tie 46 and aerate and channel moisture away from the timber tie by the coaction of pads 83, 84 and grooves 48 in pads 83 and 84 along with ribs 78, 80, 82 and the spaces 86, 88 and 90.

It will be recognized by those skilled in the art that the utilization of grooves in the center portion of the railroad tie cover or the combination of grooves and pads is related to the moisture and humidity conditions at the installation site. In most applications however resiliency is more important that aeration so that a single pad may be utilized in a railroad tie cover having means for receiving and fixing the pad. In FIG. 7 grooved or smooth elastomer pads may be employed in the tie cover.

Figure 8:
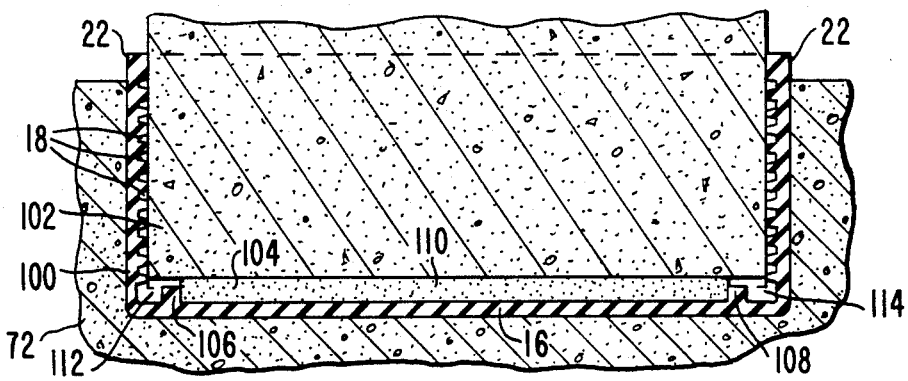
FIG. 8 is a sectional view of a further embodiment of a railroad tie cover and a resilient pad combination illustrating an application of the cover to a railroad monolithic concrete tie disposed in a concrete substrate.

Referring now to FIG. 8 a universal railroad tie cover 100 is illustrated in railroad bed 72 in which corresponding elements and reference numerals have been utilized that correspond to the railroad tie covers heretofore described. Railroad tie cover 100 is illustrated covering a monolithic concrete railroad tie 102. Center bottom 16 includes a single pad restraining opening 104 defined between ribs 106 and 108 into which a single resilient pad 110 is placed to provide resilient support for railroad tie 102. Moisture and water may be channeled away from the railroad tie by spaces 112 and 114 in a manner similar to the other embodiments of the railroad tie covers or grooves may be added to single resilient pad 110 if required for drainage.

Figure 10:
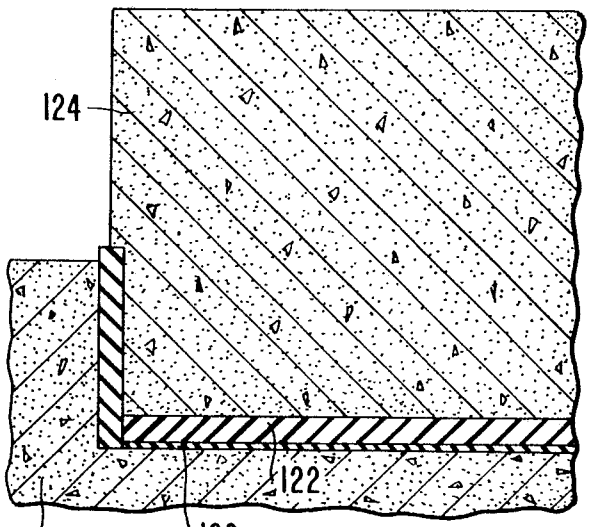
FIG. 10 is a longitudinal section of the concrete tie and railroad tie cover and resilient pad combination of FIG. 9.
Figure 9:
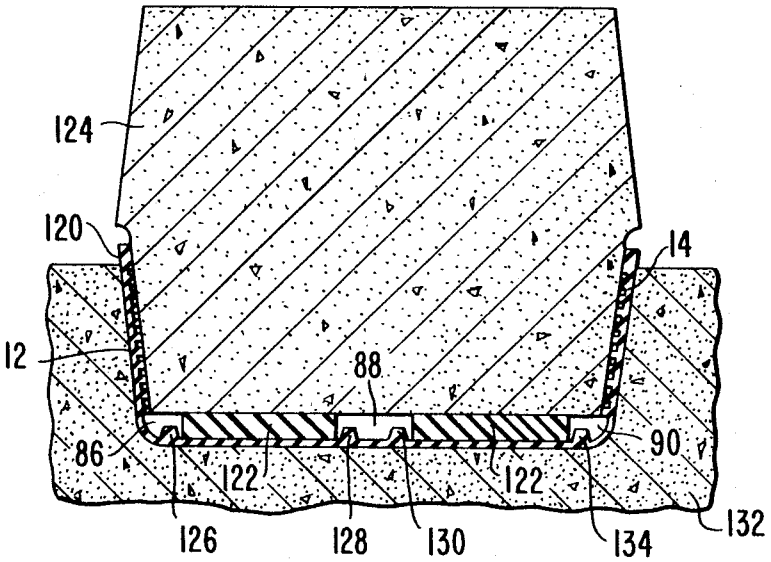
FIG. 9 is a cross sectional view of a monolithic pre cast concrete tie and a railroad tie cover and resilient pad combination disposed in a concrete substrate.
Figure 11:
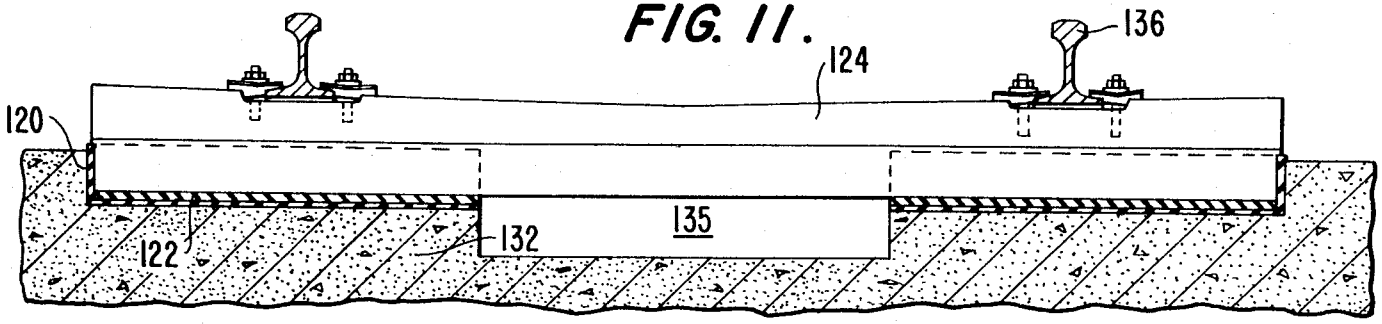
FIG. 11 is a side elevational view of railroad track on a monolithic pre cast concrete tie supported by a railroad tie cover and resilient pad combination on a concrete slab.

Referring now to FIGS. 9, 10, and 11 a universal railroad tie cover 120 including two elastomer pads 122 is illustrated supporting a monolithic pre cast concrete tie 124. The sides 12 and 14 including grooves 18 can be contoured at any angle around the sides of a railroad tie which is particularly advantageous in applications utilizing prefabricated ties of various shapes. Aeration and drainage spaces 86, 88, and 90 are provided by ribs 126, 128, 130 and 134. The provision of two ribs 128 and 130 in space 88 assists in drainage and the fixing and positioning of pads 122 in the tie cover 120. The railroad tie cover 120 supporting railroad tie 124 is supported in a concrete rail bed 132.

Rail bed 132 includes a stepped down center section 135 into which water or moisture is drained away from the tie which assists in the preservation of the system. Track 136 is fixed to railroad tie 124 as is known to those in the art and the vibration attenuation requirements of the system are accommodated by the railroad tie cover and pad combination as will be described hereinafter in greater detail.

The universal railroad tie cover and pad combination allows a single railroad tie cover to be designed that can receive a variety of interchangeable and compatible pads that can be specially designed for particular requirements. The most important conditions are the vibration dampening requirements of the system. Depending on environmental circumstances, rail bed conditions and other parameters designed for the system a railroad tie cover and pad combination should provide a single track stiffness (the deflection of one rail support when subjected to a certain load) in the range of about 30,000 lbs. per inch to 100,000 lbs. per inch. The load applied by the average wheel of a train is in the range of about 4,000 lbs. A deflection of 0.135 inch at an average wheel load of 4,000 lbs. require a pad having a stiffness of 30,000 lbs. The track stiffness can be determined as follows:

$$\frac{\text{wheel load}}{\text{deflection}} = \text{track stiffness}$$

-continued $$\frac{4{,}000}{0.135} = 30{,}000 \text{ lbs/inch approximately}$$

Figure 12:
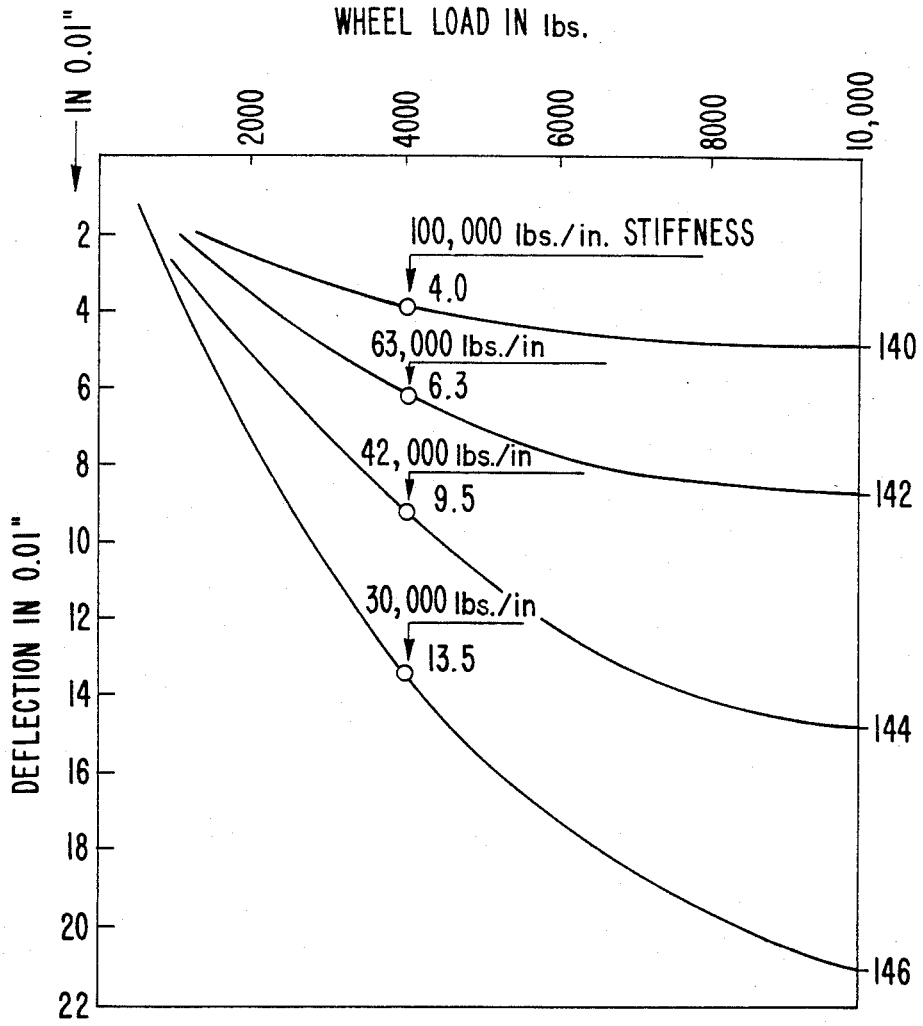
FIG. 12 is a graph illustrating various degrees of stiffnesses provided in universal railroad tie cover and pad combinations in accordance with the invention.

Similarly a deflection of 0.095 inch could be attained with a stiffness of 42,000 lbs. per inch, a deflection of 0.063 inch with a stiffness of 63,000 lbs. per inch and a deflection of 0.04 inch with a stiffness of 100,000 per inch. The provision for various stiffnesses as a result of design requirements in deflection and wheel load are illustrated in FIG. 12 by curves 140, 142, 144 and 146.

In accordance with the invention one or more elastomer strips having known deflection properties with or without grooves are added to the railroad tie covers to provide the total required deflection of the rail support under specified load. The provision of the pads in the universal tie cover in this manner provides the desired track stiffness while maintaining uniformity of the geometric details of the tracks.

The advantages of the invention reside in the utilization of a single railroad tie cover in which the specific requirements of the system are accommodated by the utilization of interchangeable pads designed to be engaged by the cover by the utilization of ribs, projections of any other means for positioning and restraining interchangeable pads in the universal railroad tie cover. The advantages in the present system allows for the modification of a single less expensive element to suit particular applications rather than the entire railroad tie cover.

The present invention as a result has a broad range of applicability to both concrete ties and timber ties where resiliency is of primary consideration. In all applications of the invention it is preferable to utilize an elastomer material having a shore A hardness in the range of 60 and then modify the resiliency of the resilient pads by changing the composition and design of the pad, increasing the percentage of grooves per square inch, increasing the depth of the grooves, or both. Typically, where the railroad timber tie cover is utilized in the ballasted track system the composite thickness of the universal railroad tie cover and pad is generally a thickness of about $\frac{3}{8}$ to $\frac{5}{8}$ of an inch measured from the outside wall to the top supporting surface of the resilient pad. The depth of grooves in the pad are about $\frac{1}{4}$ to $\frac{3}{8}$ of an inch and the grooves are in the preferred embodiment spaced along the pad at intervals of about $\frac{3}{4}$ of an inch apart.

In applications involving railroad track without ballast the composite thickness of the universal railroad tie cover and pad may be formed of slightly greater cross-sectional thickness and more particularly in the range of about $\frac{1}{2}$ to $\frac{3}{4}$ of an inch with the groove depth being typically about $\frac{3}{8}$ to $\frac{5}{8}$ of an inch and distributed along the pad at an interval of about $\frac{1}{2}$ to 1 inch.

The stability of the railroad tie cover on the universal railroad tie cover is related to the depth and width ratio of the elastomer ridges or channels. The stability is further related to the hardness of the railroad bed. In the case of a hard railroad base such as concrete the highest feasible shape factor is preferred, or in other words, a grooved or cellular channel pattern on the pads must be utilized that will not jeopardize the stability of the elastomer support while providing the highest degree of vertical deflection. In installations on softer beds such as ballast, the percentage of channels or grooves per square inch can be smaller or the depth of the channels reduced. As a result, the particular relationship of the groove width and depth and groove pattern along with the shore A hardness of the elastomer pad can be varied to suit the particular requirements for the type of railroad bed and the type of railroad tie employed.

The present invention provides advantages by providing resiliency and more evenly distributing the load and forces along the length of the railroad tie and provides aeration and the channeling of moisture away from the railroad tie. The combined function increases the useful life of both concrete and timber ties in a variety of climatic conditions which may be augmented by the utilization of grooves or a combination of grooves and resilient pads to provide the desired resiliency. The grooves in the latter embodiment serve the dual purpose of containing and locating the elastomer strips of the pad in the bottom of the railroad tie cover and providing the desired degree of resiliency and the removal of moisture.

The resilient elastomer pads employed may be of a cellular configuration or of a grooved or solid elastomer design. The novel railroad tie cover is designed to dissipate load and vibrational forces and to thereby reduce strain and increase operational life of both timber and concrete railroad ties. In addition, the novel railroad tie cover is susceptible to manufacture and shipment in a flat configuration thereby saving space while increasing the service life of railroad ties. The novel railroad tie cover further reduces noises and can be installed at the work site to meet the particular requirements of the covered railroad tie and system at the work site.

As will be recognized by those skilled in the art, the present invention has a wide range of applicability to railroad systems with or without ballast where timber railroad ties or similar ties of composite or molded material are employed. As a result of the versatility of the railroad tie cover it can be manufactured and shipped in a flat configuration and thereafter be cut at the work site to accommodate specific lengths of the railroad tie. The invention may be implemented in a variety of ways utilizing a variety of configurations for the means for receiving and fixing elastomer pads in the railroad tie cover to provide for aeration, shock and vibrational frequency dissipation. The railroad tie cover may also utilize a variety of cross-sectional widths for the novel railroad tie cover and the specially designed pads. It will be further appreciated that the present invention is susceptible to various modifications which can be made within the spirit and scope of the invention which are deemed to be included in the following claims.

What is claimed is:

1. A railroad tie cover for imparting resiliency to a track system while prolonging the life of a tie comprising a substantially rectangular sheet formed of an elastomer material having a first surface and a second surface with a first side and a second side and a center section said center section having means for receiving and fixing the position of one or more specially designed pads in said first surface of said center section, said first side and said second side connected to said center section and adapted to deform so as to orient said first surface of said first and second sides to an angle of about 90 degrees to said first surface of said center section.

2. The railroad tie cover for imparting resiliency to a rail track system while prolonging the life of a tie of claim 1 wherein said first and second sides contact opposite sides of said railroad tie when oriented at said angle and said first surface of said first side and said second side include a plurality of substantially longitudinal grooves spaced at about $\frac{1}{4}$ to $\frac{1}{2}$ inch apart from each other at a depth of about $\frac{1}{8}$ to $\frac{1}{4}$ inch.

3. The railroad tie cover for imparting resiliency to a rail track system while prolonging the life of a tie of claim 1 further comprising at least one elastomer pad.

4. The railroad tie cover for imparting resiliency to a rail track system while prolonging the life of a tie of claim 3 wherein said center section and said elastomer pad provides a static stiffness in the range of about 5 lbs. to 40 lbs. per square inch per millimeter deflection.

5. The railroad tie cover for imparting resiliency to a rail track system while prolonging the life of a tie of claim 4 wherein said static stiffness is achieved by employing a plurality of grooves spaced at about $\frac{1}{4}$ to 1 inch from each other and at a depth of about $\frac{1}{4}$ to $\frac{3}{8}$ of an inch on said elastomer pad.

6. The railroad tie cover for imparting resiliency to a rail track system while prolonging the life of a tie of claim 5 wherein said static stiffness of said center portion is in the range of about 15 to 40 lbs. per square inch per millimeter deflection.

7. The railroad tie cover for imparting resiliency to a rail track system while prolonging the life of a tie of claim 3 wherein said rectangular sheet includes a plurality of openings for receiving a plurality of pads which composite provides a static stiffness in the range of about 5 lbs. to 40 lbs. per square inch per millimeter deflection.

8. The railroad tie cover for imparting resiliency to a rail track system while prolonging the life of a tie of claim 3 wherein said means for receiving and fixing said pad is a single opening and said static stiffness is achieved by a single opening into which a single elastomer pad is disposed for supporting said railroad tie.

9. The railroad tie cover for imparting resiliency to a rail track system while prolonging the life of a tie of claim 8 wherein said rectangular sheet includes drainage channels disposed adjacent to said sides of said pad.

10. The railroad tie cover for imparting resiliency to a rail track system while prolonging the life of a tie of claim 3 wherein said first and second sides further include a plurality of first grooves disposed substantially parallel along the length of said first and second sides.

11. The railroad tie cover for imparting resiliency to a rail track system while prolonging the life of a tie of claim 10 wherein said first and second sides further include a plurality of cross grooves disposed substantially perpendicular to said first grooves.

12. The railroad tie cover for imparting resiliency to a rail track system while prolonging the life of a tie of claim 3 wherein said pad is a closed cell elastomer pad.

13. The railroad tie cover for imparting resiliency to a rail track system while prolonging the life of a tie of claim 3 wherein said pad is a grooved elastomer pad.

14. The railroad tie cover for imparting resiliency to a rail track system while prolonging the life of a tie of either claim 12 or 13 wherein said pads and center section combination provides a static stiffness in the range of about 5 lbs. to 20 lbs. per square inch per millimeter deflection.

15. The railroad tie cover for imparting resiliency to a rail track system while prolonging the life of a tie of claim 3 wherein said center section and said elastomer pad provides a deflection in the range of about 0.14 to 0.04 inch.

16. The railroad tie cover for imparting resiliency to a rail track system while prolonging the life of a tie of claim 15 wherein said deflection is achieved by employing a plurality of grooves spaced at about $\frac{1}{4}$ to 1 inch from each other and at a depth of about $\frac{1}{4}$ to $\frac{3}{8}$ of an inch on said elastomer pad.

17. The railroad tie cover for imparting resiliency to a rail track system while prolonging the life of a tie of claim 15 wherein said means for receiving and fixing said pad is a single opening and said deflection is achieved by a single opening into which a single elastomer pad is disposed for supporting said railroad tie.

18. The railroad tie cover for imparting resiliency to a rail track system while prolonging the life of a tie of claim 17 wherein said rectangular sheet includes drainage channels disposed adjacent to said sides of said pad.

19. The railroad tie cover for imparting resiliency to a rail track system while prolonging the life of a tie of claim 17 wherein said pad is a closed cell elastomer pad.

* * * * *